US005292191A

United States Patent [19]

Slivon

[11] Patent Number: 5,292,191

[45] Date of Patent: Mar. 8, 1994

[54] LATCH MECHANISM FOR A CABINET DRAWER

[75] Inventor: George R. Slivon, Kenosha, Wis.

[73] Assignee: Snap-on Tools Corporation, Kenosha, Wis.

[21] Appl. No.: 797,049

[22] Filed: Nov. 25, 1991

[51] Int. Cl.[5] ..... A47B 95/00

[52] U.S. Cl. ..... 312/332.1; 292/128

[58] Field of Search ..... 292/24, 31, 121, 128; 312/332.1, 222

[56] References Cited

U.S. PATENT DOCUMENTS

| | | | |
|---|---|---|---|
| Re. 28,280 | 12/1974 | Aleks . | |
| 3,031,248 | 4/1962 | Jeeves . | |
| 3,107,958 | 10/1963 | Robbins | 312/332.1 |
| 3,161,923 | 12/1964 | Crain | 292/128 |
| 3,218,112 | 11/1965 | Stark . | |
| 3,239,298 | 3/1966 | McCarthy . | |
| 3,245,744 | 4/1966 | Olson . | |
| 3,252,746 | 5/1966 | Kafferlin et al. | 312/332.1 |
| 3,574,436 | 4/1971 | Anderson . | |

*Primary Examiner*—James R. Brittain
*Assistant Examiner*—Gerald A. Anderson
*Attorney, Agent, or Firm*—Emrich & Dithmar

[57] ABSTRACT

A latch mechanism includes a trim member secured to a drawer pull at the front of a drawer. An actuator plate is located under the drawer pull and is disposed in a slot of a trim member on the drawer pull. A keeper is located on a side wall of the cabinet adjacent the hook. A hook is attached to one end of the actuator plate and is arranged to engage the keeper when the drawer is closed. The hook is releasable from the keeper by pivoting the actuator plate toward the drawer pull to open the drawer.

11 Claims, 1 Drawing Sheet

LATCH MECHANISM FOR A CABINET DRAWER

BACKGROUND OF THE INVENTION

Known latch mechanisms for holding drawers in a closed position of the type that automatically latch before closing the drawer are typically comprised of many parts. As a result, manufacture is undesirably complicated and expensive.

SUMMARY OF THE INVENTION

It is a general object of the present invention to provide an improved latch mechanism for a cabinet drawer which is of simpler construction.

In summary, there is provided a latch mechanism for a drawer of a cabinet including side walls, the drawer including an elongated drawer pull having a depending member with a free end, the latch mechanism comprising means at the free end of the depending member defining a slot, an elongated actuator plate on the underside of the drawer pull and extending substantially the length of the drawer pull, the actuator plate being disposed in the slot for pivotal movement thereof, a hook at one end of the actuator plate, and a keeper on the adjacent one of the side walls of the cabinet, the hook being arranged to engage the keeper when the drawer is closed, the hook being releasable from the keeper by pivoting the actuator plate toward the drawer pull.

According to one embodiment of the invention, the means for receiving the actuator plate is a separate trim member secured to the depending member of the drawer pull, the trim member having a slot for securely receiving the free end of the depending member of the drawer pull.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF A PREFERRED EMBODIMENT

Figure 1:
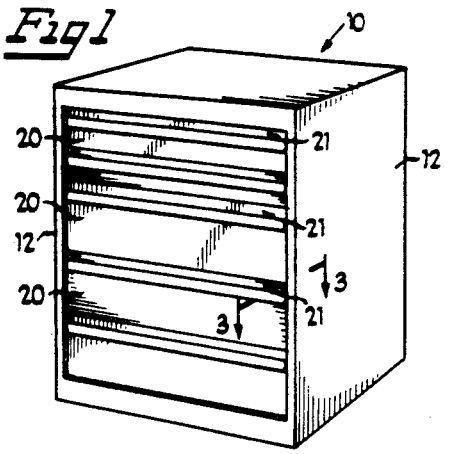
FIG. 1 is a perspective view of a cabinet containing a plurality of drawers.
Figure 2:
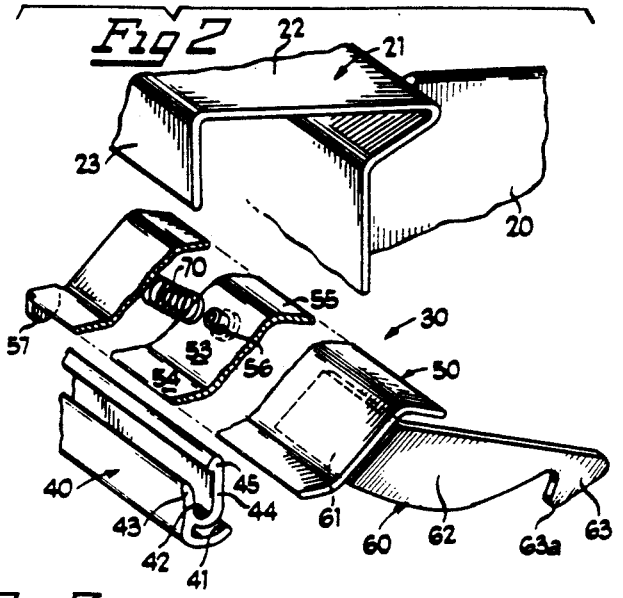
FIG. 2 is an exploded, perspective, fragmentary view, on an enlarged scale, of one of the latch mechanisms in the cabinet of FIG. 1, which mechanism embodies the features of the present invention.
Figure 3:
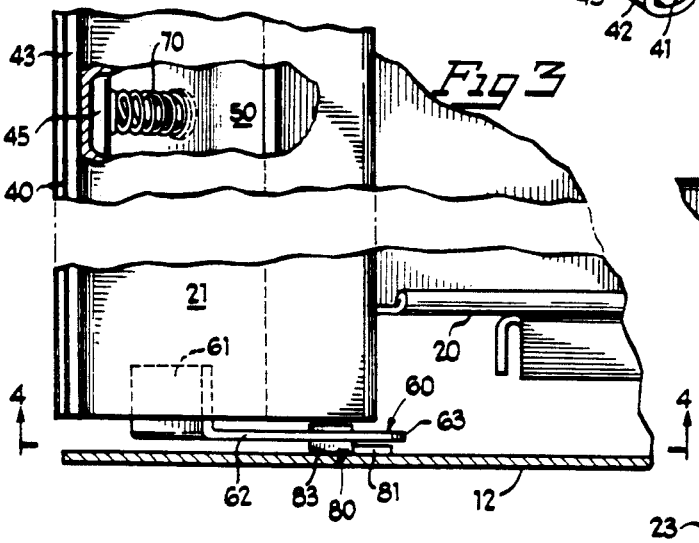
FIG. 3 is a sectional, fragmentary view, on an enlarged scale, of the latch mechanism, taken along the line 3—3 of FIG. 1.
Figure 6:
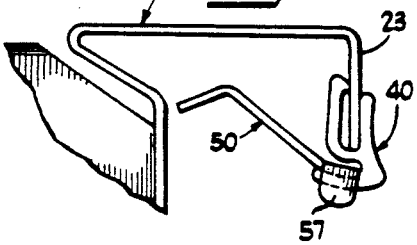
FIG. 6 is a side-elevational view of the opposite end of the latch mechanism.

Turning now to the drawings and, more particularly, to FIG. 1 thereof, there is depicted a tool storage cabinet, generally designated 10, including side walls 12 and a plurality of sliding drawers 20. An elongated metal drawer pull 21 is located at the front end of each of the drawers 20 and extends along its entire length Referring to FIGS. 2–6, each drawer pull 21 has a generally horizontal portion 22 and a generally vertical portion 23 depending therefrom.

Associated with each pull 21 is a latch mechanism 30 embodying the features of the present invention. Latch mechanism 30 comprises an elongated metal trim member 40 which includes a generally horizontal slot 41 and a generally vertical slot 42, both extending the length of member 40. Slot 42 is defined by the space between two legs 43 and 44 which are slightly converging. The outer end of leg 44 is enlarged, defining a head 45. Trim member 40 is secured to member 23 of drawer pull 41 by virtue of member 23 being disposed between legs 43 and 44. Because of the convergence of the legs and their resilience, member 23 is tightly gripped between leg 43 and head 45.

Latch mechanism 30 further comprises an elongated metal actuator plate 50, of generally flattened S shape, including an intermediate portion 53 and end portions 54 and 55. A stud 56 is secured to portion 53 generally centrally thereon. One end of portion 54 is bent downwardly to form a tab 57. Actuator plate 50 is located under drawer pull 21. Portion 54 thereof is loosely located in slot 41 of trim member 40. Plate 50 is, therefore, pivotable with respect to member 40.

Latch mechanism 30 additionally comprises a latch member 60 including a base 61, an arm 62 depending therefrom, and a hook 63 at the end of arm 62. The rear end of hook 63 defines a camming surface 63*a*. Base 61 is attached as by welding to the underside of portion 53 at the end thereof opposite to tab 57. As a result, arm 62 extends laterally from plate 50. Latch member 60 and tab 57 prevent plate 50 from sliding longitudinally in slot 41, thus preventing plate 50 from sliding out at the ends of trim member 40.

Latch mechanism 30 further comprises a spring 70, one end of which is secured to leg 44 of trim member 40 and the other end of which is secured to stud 56 on the plate 50. Spring 70 biases actuator plate 50 clockwise, as viewed in FIG. 4.

Latch mechanism 30 further comprises keeper structure 80 which includes a base 81, an arm 82 extending upwardly therefrom, and a keeper 83 extending outwardly and perpendicularly from arm 82. Base 81 is secured to side wall 12 of cabinet 10 adjacent latch member 60.

Hook 63 is biased clockwise by gravity and the action of spring 70, so as to be automatically hooked onto keeper 83 when the drawer is closed.

Figure 5:
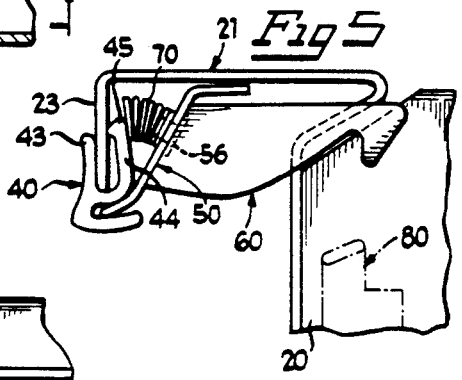
FIG. 5 is a side-elevational view of the latch mechanism, similar to FIG. 4, but in its unlatched condition.
Figure 4:
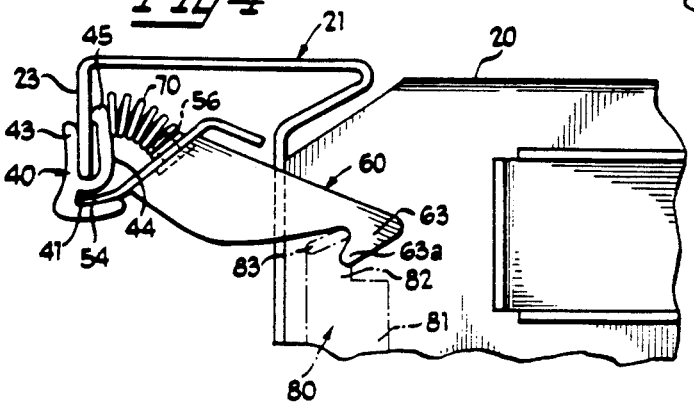
FIG. 4 is a side-elevational view of the latch mechanism, taken along the line 4—4 of FIG. 3, in its latched condition.

In order to open a drawer, one's fingers are placed beneath the drawer pull 21 and in contact with intermediate portion 53 of actuator plate 50. As one pulls against the drawer pull 21 so as to open the drawer, actuator 50 is pivoted counterclockwise towards member 23. As a result, latch member 60 is disengaged from keeper 83, thereby unlatching the latching mechanism as depicted in FIG. 5. Drawer pull 21 can be grasped at any point along the length thereof to unlatch the latching mechanism and enable drawer 20 to be opened. Then, actuator 50 is released whereupon latch member 60 returns to its maximum clockwise position under the influence of spring 70 and gravity. When the drawer is thereafter closed, cam surface 63*a*, being aligned with keeper 83 strikes it, causing member 60 to be pivoted counterclockwise until it clears the keeper, and then snaps to the latching position depicted in FIG. 4 by the action of spring 70.

What has been described therefore is an improved latch mechanism of simpler construction than that heretofore available. While a particular embodiment of this invention has been described, it is understood that changes can be made therein without departing from the spirit and scope of the invention as defined in the claims.

What is claimed is:

1. A latch mechanism for a drawer of a cabinet having side walls, the drawer including an elongated drawer pull fixed to the drawer having a length and a depending member with a free end, said latch mechanism comprising: coupling means at the free end of the depending member for defining a first slot, said coupling means including a trim member secured to the depending member of the drawer pull, said trim member having said first slot and a second slot, said second slot securely receiving the free end of the depending member of the drawer pull, an elongated actuator plate under the drawer pull and extending substantially the length of the drawer pull, said actuator plate being disposed in said first slot for pivotal movement, said actuator plate having one end thereof disposed adjacent to one of the side walls, a hook at said one end of said actuator plate, and a keeper on said one of the side walls of the cabinet, said hook being arranged to engage said keeper when the drawer is closed, said hook being releasable from said keeper by pivoting said actuator plate toward the drawer pull.

2. The latch mechanism of claim 1, wherein said coupling means is discrete from and attached to the depending member.

3. The latch mechanism of claim 1, wherein said actuator plate is positioned adjacent and along the inner edge of said drawer pull so as to be pivotally movable toward the release position when the drawer pull is pulled.

4. The latch mechanism of claim 1, wherein said second slot is defined by converging first and second legs, the depending member of the drawer pull being disposed between said legs and gripped thereby.

5. The latch mechanism of claim 4, wherein said first leg has a head at one end thereof, said head of said first leg and said second leg being disposed against the depending member.

6. The latch mechanism of claim 1, and further comprising a spring means between the drawer pull and said actuator plate for biasing said hook toward the latching position thereof.

7. The latch mechanism of claim 1, wherein said actuator plate is of flattened S shape and includes an intermediate portion and end portions, one of said end portions being disposed in said slot.

8. The latch mechanism of claim 7, wherein said hook is attached to said intermediate portion of said actuator plate.

9. The latch mechanism of claim 1, wherein said hook includes a rear end defining a camming surface and said keeper includes a flange, said camming surface being arranged to strike and then clear said flange to latch said drawer while the drawer is being closed.

10. A cabinet comprising: wall structure including side walls; a drawer mounted in said wall structure for movement between open and closed conditions, said drawer including an elongated drawer pull fixed to said drawer and having a length and a depending member with a free end; latch mechanism, said latch mechanism including coupling means at the free end of said depending member for defining a first slot, said coupling means including a trim member secured to the depending member of the drawer pull, said trim member having said first slot and a second slot, said second slot securely receiving the free end of the depending member of the drawer pull, an elongated actuator plate under said drawer pull and extending substantially the length of said drawer pull, said actuator plate being disposed in said first slot for pivotal movement, said actuator plate having one end thereof disposed adjacent to one of the side walls, and a hook at said one end of said actuator plate; and a keeper on one of said side walls; said hook being arranged to engage said keeper when said drawer is in its closed condition, said hook being releasable from said keeper by pivoting said actuator plate toward said drawer pull.

11. A drawer for a cabinet including side walls and a keeper on one of the side walls, said drawer comprising: an elongated drawer pull fixed to the drawer and having a length and a depending member with a free end, coupling means at the free end of said depending member for defining a first slot, said coupling means including a trim member secured to the depending member of the drawer pull, said trim member having said first slot and a second slot, said second slot securely receiving the free end of the depending member of the drawer pull, an elongated actuator plate under said drawer pull and extending substantially the length of said drawer pull, said actuator plate being disposed in said first slot for pivotal movement, said actuator plate having one end thereof disposed adjacent to one of the side walls, a hook at said one end of said actuator plate, and a keeper on said one of the side walls of the cabinet, said hook being arranged to engage said keeper when the drawer is closed, said hook being releasable from said keeper by pivoting said actuator plate toward the drawer pull.

* * * * *